United States Patent [19]

Kinsworthy

[11] Patent Number: 4,890,598

[45] Date of Patent: Jan. 2, 1990

[54] HIGH EFFICIENCY BLOWER

[75] Inventor: Donald D. Kinsworthy, Dayton, Ohio

[73] Assignee: Nu-Tech Industries, Inc., Dayton, Ohio

[21] Appl. No.: 225,924

[22] Filed: Jul. 29, 1988

[51] Int. Cl.[4] ..... F24H 3/02

[52] U.S. Cl. ..... 126/110 D; 126/110 R; 126/110 A; 165/123

[58] Field of Search ..... 126/110 D, 110 R, 110 A, 126/110 E, 109, 112; 165/123, 124, 126, 127, 121, 122; 415/108, 175, DIG. 7

[56] References Cited

U.S. PATENT DOCUMENTS

| | | | |
|---|---|---|---|
| 2,722,404 | 11/1955 | Koff | 165/123 X |
| 2,951,685 | 9/1960 | Bliss et al. | 165/123 |
| 3,194,307 | 7/1965 | Wood | 165/123 |
| 4,382,199 | 5/1983 | Isaacson . | |
| 4,492,903 | 1/1985 | Knight et al. . | |

FOREIGN PATENT DOCUMENTS

| | | | |
|---|---|---|---|
| 1188946 | 9/1959 | France | 165/123 |

OTHER PUBLICATIONS

Bryant Air Conditioning, GF-32, (Model 398A Deluxe Gas-Fired Condensing Furnace, Catalog) Aug. 1984.

The Lau Blower Company, II-1, 1 p., Section II: Lau Blower Units Engineering Catalog, Lau Div. Philips Ind., Sep. 1964.

The Lau Blower Company, II-36, 1 p., Direct Drive Blowers Engineering Catalog, Lau Division Philips Ind., Sep. 1964.

The Lau Blower Company, IV-2, Catalog LSO 463, Parts Breakdown for Series A, Econopak and Budget Blowers, 1 p., Engineering Catalog, Sep. 1964.

The Lau Blower Company, IV-6, Catalog LSO 463, Parts Breakdown for Lau Direct Drive Blowers, 1 p., Engineering Catalog, Sep. 1964.

*Fan Engineering*-Buffalo Forge Company, pp. 350-355 (1948).

*Primary Examiner*—Larry Jones

*Attorney, Agent, or Firm*—Wood, Herron & Evans

[57] ABSTRACT

A jet blower having a housing, a cylindrical chamber, a blower wheel in the chamber, four tangential passageways from said chamber, the passageways terminating in axially-directed nozzles and a Venturi foil surrounding each nozzle.

7 Claims, 2 Drawing Sheets

HIGH EFFICIENCY BLOWER

This invention relates to a blower, and more particularly to a blower of the type used in conjunction with a residential furnace.

A residential furnace has a heat exchanger presenting an area of about 2'×2', for example, onto which air is directed by a blower for heating by the heat exchanger and subsequent distribution throughout the residence. As will appear below, the size of the heat exchanger and the size and capacity of the blowers used in conjunction with the heat exchanger will vary depending upon the furnace configuration and the size of the residence to be heated.

The blower that is in the greatest use in residential furnaces is a conventional blower having forward, curved impellers. That blower is recognized as having a relatively low efficiency. It requires quite a sizeable blower compartment, of at least 17"×18"× 18". Approximately ten configurations of the blower are required to accommodate all of the popular furnace sizes and configurations.

Another centrifugal blower, the backward inclined (BI) blower, has a substantially higher efficiency than the forward curved blower, but it requires a large casing and high speeds. The BI blower is not compatible with existing furnace casings. If the BI blower impellers are made smaller and run faster, they have very high pressure characteristics, but low flow characteristics. Again, they are not compatible with existing furnaces.

An objective of the present invention has been to provide an improved blower having a high efficiency, requiring a small casing, and wherein only about three configurations would be required to handle practically all residential requirements.

The objective of the present invention has been attained by using the principle of the high efficiency jet blower or pump, but with a new configuration. The jet blower has a discharge nozzle centered in a Venturi tube. The high velocity jet from the nozzle entrains air passing through the Venturi. The air is directed tangentially from the impeller as is customary with centrifugal blowers. In its known configuration, the pattern of air emanating from the nozzle of the jet blower is too small for the area of the heat exchanger. A large, somewhat conical conduit would be required to provide the space for expansion of the air pattern so as to contact all of the area of the heat exchanger toward which it is directed. Such a conduit between the blower and the heat exchanger would require a totally unacceptably large amount of space.

Therefore, another objective of the present invention has been to redesign the jet blower so as to provide a large discharge pattern of air but with a small blower casing.

This objective of the invention has been attained by providing the blower with four equiangularly-spaced nozzles, each capturing the air from the impeller and directing it parallel to the axis of rotation of the impeller. The four nozzle configuration of the blower can cover the whole heat exchanger area efficiently. The exit direction is the same as the inlet direction, as contrasted to the normal centrifugal blower configuration wherein the exit air is directed at 90° to the inlet air. Thus, there is an improvement in the efficiency of the jet blower.

The blower of the present invention is quite compact, occupying a blower compartment of about 16"×16"× 8". Thus, it can be seen that the compartment containing a blower of the present invention is about one-half the length of a compartment containing a conventional blower. Further, the conventional blower having a single tangential exit orifice does not direct the force of its air equally onto all parts of the heat exchanger. With the blower of the present invention, the air will be substantially uniformly applied to all portions of the heat exchanger.

As a further feature of the invention, it is contemplated that the impeller will be driven by a programmable brushless DC motor of the type shown in U.S. Pat. Nos. 4,382,199 and 4,492,903. The motor permits a gradual startup of the blower so that when the furnace is turned on, the blower will not cause a blast of cold air from the cold ducts throughout the residence. The blower of the present invention with the brushless DC motor can be made to start at a lower speed and increase its speed as the furnace and air warm up.

With the combination of the improved blower and the programmable brushless DC motor, about three configurations of blowers should satisfy the bulk of all residential needs since, with the brushless DC motor, specific speeds and horsepower can be programmed into the single rotor and stator configuration. That motor, with the capability of varying its output, can drive the blower of the present invention through a wider range of airflow than is possible with conventional systems.

The several features and objectives of the present invention will become more readily apparent from the following detailed description taken in conjunction with the accompanying drawings in which:

BRIEF DESCRIPTION OF THE DRAWINGS

As shown in FIG. 1, a blower 10 is mounted in a blower compartment 11 and is adapted to direct air across a heat exchanger 12.

Referring to FIGS. 2 through 5, the blower has a housing 15. A blower wheel, preferably a backward-inclined blower wheel 16, is rotatably mounted in the housing 15 on an axis 17. A motor 18 is directly connected to the blower wheel 16. It should be understood that the direct drive could be replaced by a belt drive depending upon how the motor is mounted.

Figure 1:
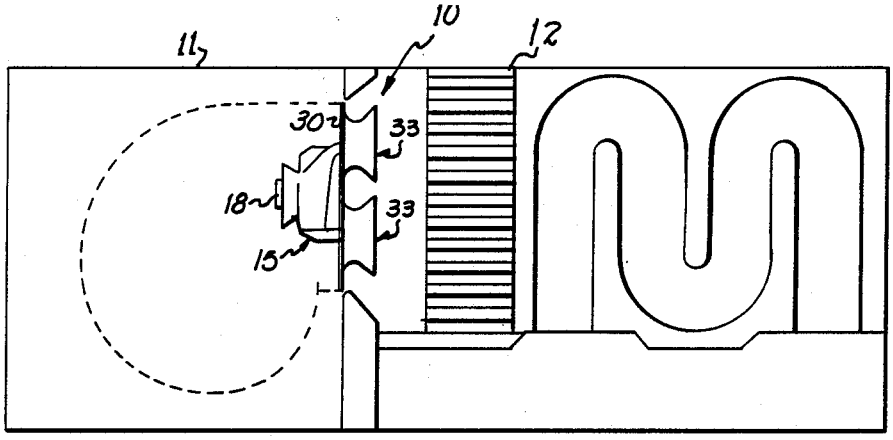
FIG. 1 is a diagrammatic cross-sectional view of a blower and heat exchanger for a residential furnace.
Figure 2:
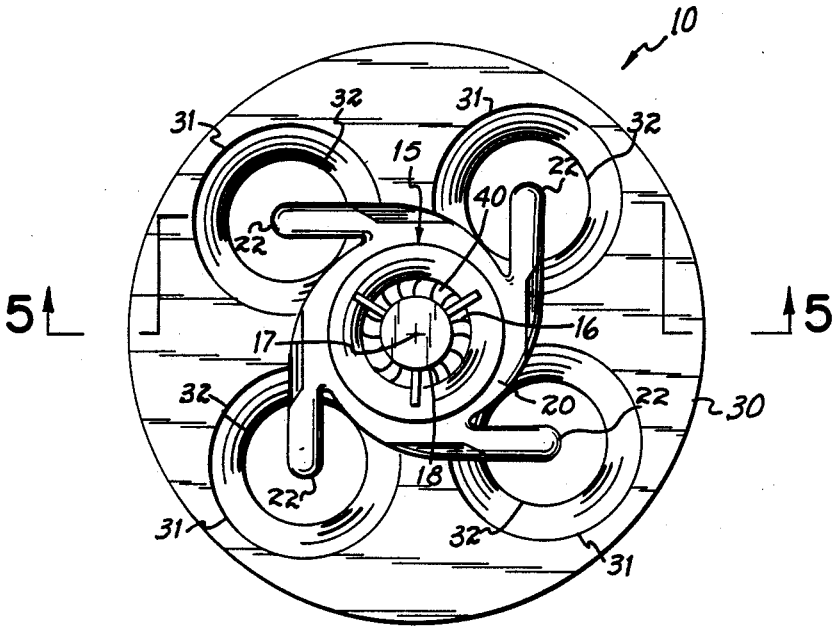
FIG. 2 is a rear elevational view of the blower.
Figure 3:
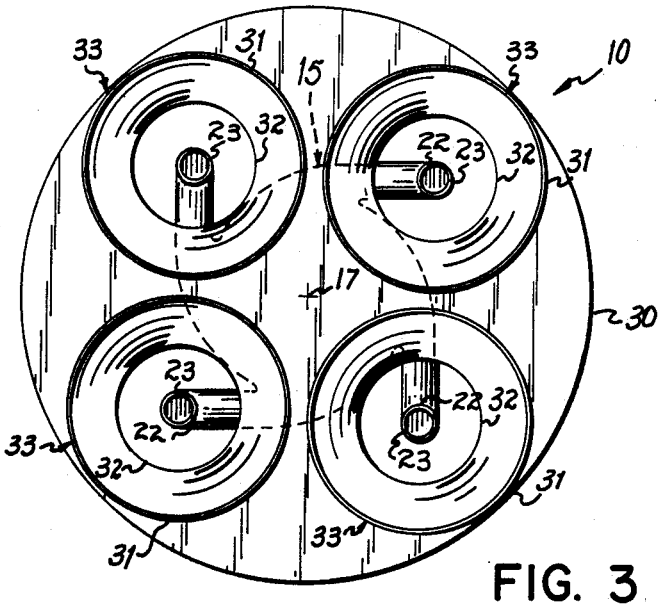
FIG. 3 is a front elevational view of the blower.
Figure 4:
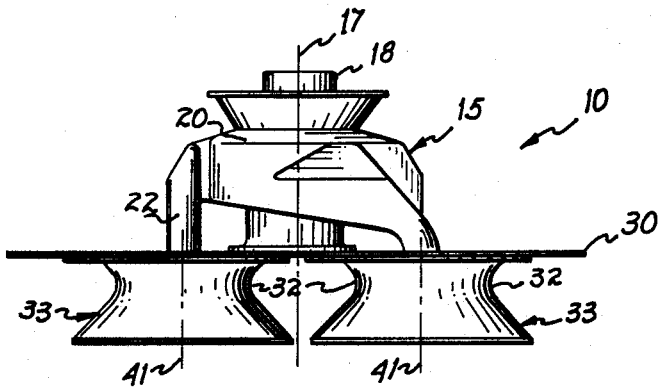
FIG. 4 is a side elevational view of the blower.
Figure 5:
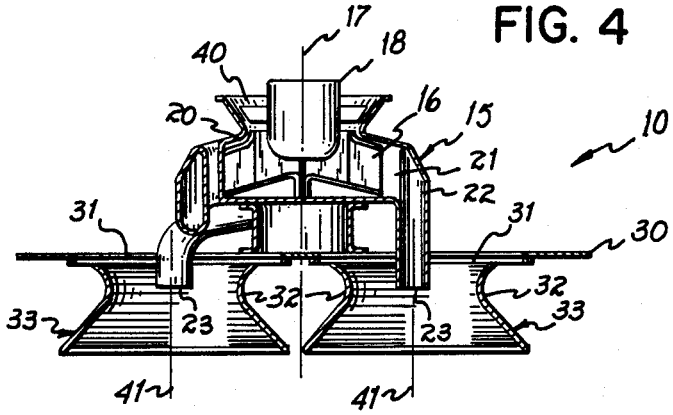
FIG. 5 is a cross-sectional view taken along lines 5—5 of FIG. 2.

The housing creates a generally cylindrical blower wheel chamber 20. Four passageways 21 extend tangentially from the chamber 20 and are equiangularly-spaced around the housing. Each passageway has a right angle transition 22 and terminates in a nozzle 23.

A plate 30 extends across the discharge side of the housing 15. It has four openings 31 with a nozzle 23 passing through each opening. Each nozzle terminates in the throat 32 of a Venturi 33 mounted on the plate 30 and surrounding the respective nozzle 23.

The housing has an inlet opening 40 surrounding the motor 18, the inlet opening having an axis coincident with the blower axis 17.

The nozzles 23 have axes 41 that are parallel to the axis 17. Thus, the air enters the blower parallel to the axis of the blower and leaves parallel to the axis of the blower, but internally of the housing goes through certain angular transitions. In exiting trough the nozzles 23, the jets of air passing through the nozzles 23 entrain air through the Venturi air foils. The air exiting from the Venturis at 33 is of fairly uniform velocity across the composite four Venturi outlet and is of large volume or CFM arising out of the use of the efficient jet pump.

From the above disclosure of the general principles of the present invention and the preceding detailed description of a preferred embodiment, those skilled in the art will readily comprehend the various modifications to which the present invention is susceptible. Therefore, I desire to be limited only by the scope of the following claims and equivalents thereof:

I claim:

1. A jet blower comprising:

a blower wheel, and means for rotating said blower wheel, a housing, said housing having (a) a generally cylindrical chamber receiving said blower wheel on an axis, (b) a plurality of tangential discharge passageways tangentially connected to said blower wheel chamber, (c) each passageway terminating in a nozzle directed parallel to said axis, and a Venturi surrounding each said nozzle, whereby jets of air discharging from said nozzles entrain air passing through said Venturis and blow said air generally parallel to said axis.

2. A jet blower as in claim 1, said housing further including a transition of gradually decreasing cross-sectional area from each said passageway to said nozzle.

3. A jet blower as in claim 1 in which there are four equiangularly-spaced nozzles surrounding said axis.

4. A jet blower as in claim 1 in which said drive means comprises a programmable brushless DC motor.

5. A jet blower as in claim 4 in which said motor is programmed for operation with a hot air furnace to start slowly and to increase speed as the air warms up.

6. A jet blower as in claim 1 in which said blower wheel is a single inlet backward inclined blower wheel.

7. A jet blower as in claim 6 in which said blower wheel is about 4.25 inches in diameter and the discharge area of said blower is about 15 inches by 15 inches.

* * * * *